US010466007B2

(12) United States Patent
Reasor

(10) Patent No.: US 10,466,007 B2
(45) Date of Patent: Nov. 5, 2019

(54) GRASPING FRONT SUPPORT BAG FOR FIREARM STABILITY

(71) Applicant: Clifton Walker Reasor, Trenton, GA (US)

(72) Inventor: Clifton Walker Reasor, Trenton, GA (US)

( * ) Notice: Subject to any disclaimer, the term of this patent is extended or adjusted under 35 U.S.C. 154(b) by 0 days.

(21) Appl. No.: 16/034,566

(22) Filed: Jul. 13, 2018

(65) Prior Publication Data

US 2018/0328691 A1 Nov. 15, 2018

Related U.S. Application Data

(63) Continuation of application No. 15/792,232, filed on Oct. 24, 2017, now Pat. No. 10,048,034.

(60) Provisional application No. 62/486,831, filed on Apr. 18, 2017.

(51) Int. Cl.
*F41A 23/16* (2006.01)

(52) U.S. Cl.
CPC ..... *F41A 23/16* (2013.01)

(58) Field of Classification Search
CPC ..... F41A 23/00; F41A 23/02; F41A 23/16; F41A 23/18; F41A 23/12; F41A 23/08; F41A 23/04; F41A 23/06; F41A 23/10; F41A 23/14
USPC ..... 42/94; 89/37.04
See application file for complete search history.

(56) References Cited

U.S. PATENT DOCUMENTS 5,233,779 A 8/1993 Shaw
5,332,185 A 7/1994 Walker, III
5,784,820 A * 7/1998 Wood ..... F41C 33/001 42/94
5,875,580 A 3/1999 Hill et al.
7,866,081 B2 1/2011 Seuk
2002/0088057 A1* 7/2002 Wassilefsky ..... A47C 20/021 5/648
2008/0263928 A1* 10/2008 Potterfield ..... F41A 23/16 42/94
2010/0175192 A1* 7/2010 Aiken ..... A47C 20/021 5/632

(Continued)

OTHER PUBLICATIONS https://www.tacticalworks.com/Modular-Pump-Pillow-Multicam-by-Wiebad.html ; Aug. 28, 2016 (wayback) (Year: 2016).*

(Continued)

*Primary Examiner* — Joshua E Freeman

(74) *Attorney, Agent, or Firm* — Eric B. Fugett; Mark A. Pitchford; Pitchford Fugett, PLLC

(57) ABSTRACT

A grasping front support shooting bag for firearm stability has a 'W' shape and mass that increases the surface are contact to the firearm and applies support to the firearm at two points spaced apart from each other along the fore end or hand guard of the firearm. The shooting bag has a deliberate shape that allows the shooting bag to conform to substructures or substrates (i.e., objects from which a shot is to be taken) of all shapes to provide a flattened rest that supports multiple types of firearms. The shooting bag is composed of textiles sewn into a unique shape and filled with polypropylene (or other synthetic material) beads that are proportionally massed to provide expanded, pliable surface area to an object to aid in stability for the shooter in any hunting, recreation, competition, or law enforcement capacity.

14 Claims, 10 Drawing Sheets

(56) References Cited

U.S. PATENT DOCUMENTS

2010/0287810 A1* 11/2010 Kleppe ..... F16M 11/28
42/94
2015/0282647 A1* 10/2015 Hall ..... A47G 9/10
5/636

OTHER PUBLICATIONS http://www.thewildgrizzly.com/wild-grizzly-large-forest-camouflage-camera-video-photography-dslr-bean-bag-support/.
http://www.dog-gone-good.com/index.html; window bag.
http://www.bullsbag.com/Multi_Purpose_Bench_Rest_Shooting_Rests_Models_X7_Bulls_Bag_s/6.htm.
http://www.btibrands.com/product/deadshot-boxed-combo-front-rear-bag-filled/.
http://www.btibrands.com/product/blind-bag-filled/.
http://www.btibrands.com/product/universal-front-rest-bag-narrow-sporter-forend-unfilled/.
http://www.btibrands.com/product/ar-deadshot-tactical-bag-set/.
https://www.amazon.com/Grizzly-Camera-Bean-Bag-Medium-Black/dp/B00C8SKUTI.
https://www.google.com/search?q=caldwell+shooting+bag&rtz=1C1GGRV_enUS751US751&source=lnms&thm=shop&sa=X&ved=0ahUKEwigx7qigpzYAhYJTCYKHW5WA2YQ_AUiCigB&biw=1047&bih=548.

* cited by examiner

GRASPING FRONT SUPPORT BAG FOR FIREARM STABILITY

CROSS-REFERENCES TO RELATED APPLICATIONS

This application is a continuation of co-pending U.S. Non-Provisional patent application Ser. No. 15/792,232, entitled "Grasping Front Support Bag for Firearm Stability" and filed Oct. 24, 2017, which claims priority to U.S. Provisional Patent Application No. 62/486,831, entitled "Grasping Front Support Bag for Firearm Stability" and filed on Apr. 18, 2017, the entire contents of both of which applications are hereby incorporated by reference in their entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to non-mechanical shooting support bags at least partially filled with polycarbonate or organic compounds that are pliable for minute adjustments by the end user.

Shooting supports for precision marksmanship generally come in the form of bench rests. These are mechanical devices to which a long gun (i.e., a shotgun, smooth bore firearm, or rifle) is affixed. Fine adjustments to the aim of the gun are made by turning threaded adjusters on the bench rest. Another type of shooting support is shooting bags (e.g., sandbags). Traditional shooting support bags are generally used as rear support (i.e., support under a stock or butt of a long gun) for making minute adjustments for precise point of aim in reference to a target. The front of the gun rests on a hardened object (e.g., a bipod affixed to the fore end or hand guard of the gun) and the aim of the firearm is adjusted by the user manipulating the fill in the bag supporting the butt of the firearm. Mechanical shooting supports (i.e., bench rests) are generally not adaptable to any uses other than shooting from flat surfaces such as tables or the ground. Traditional shooting bags are useful for shooting from a table or the ground, but do not help a shooter stabilize a long gun for precision shooting when shooting from various positions and objects in the field other than the ground. For example, shooting bags designed to support the butt of a long gun are not useful when shooting from a vehicle, a fence or fence post, or over a tree limb (i.e., when the fore end or handguard of the long gun is supported by these various objects).

BRIEF SUMMARY OF THE INVENTION

Aspects of the present invention provide a grasping front support shooting bag for firearm stability. The shooting bag has a 'W' shape and mass that increases the surface area contact to the firearm and applies support to the firearm at two points spaced apart from each other along the fore end or hand guard of the firearm. The shooting bag has a deliberate shape that allows the shooting bag to conform to substructures or substrates (i.e., objects from which a shot is to be taken) of all shapes to provide a flattened rest that supports multiple types of firearms. The shooting bag is composed of textiles sewn into a unique shape and filled with polypropylene (or other synthetic material) beads that are proportionally massed to provide expanded, pliable surface area to an object to aid in stability for the shooter in any hunting, recreation, competition, or law enforcement capacity.

In one aspect of the invention, a shooting support includes a main chamber, a first lower chamber, a second lower chamber, and a filler. The first lower chambers connected to the main chamber. The second lower chambers connected to the main chamber. The filler is contained within the main chamber, the first lower chamber, and the second lower chamber. The main chamber, the first lower chamber, and the second lower chamber are in fluid communication with one another such that the filler can flow between all of the main chamber, the first lower chamber, and the second lower chamber.

In another aspect, shooting support includes a first panel having a butterfly outline, the second panel having a butterfly outline, and a joining panel. The joining panel joins the first panel to the second panel along the outline of each of the first panel and the second panel such that the butterfly outlines of the first and second panels are aligned.

In another aspect, the shooting support includes a first bag, and a second bag. The first and second bags are configured to selectively attach to one another.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
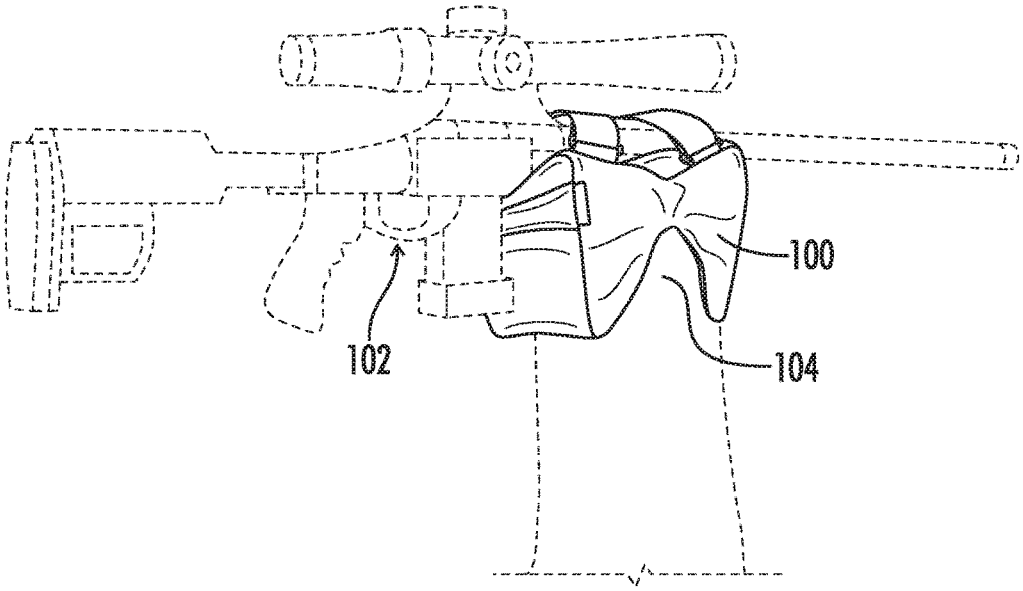
FIG. 1 is an isometric view of a shooting support on an object supporting a long gun.
Figure 2:
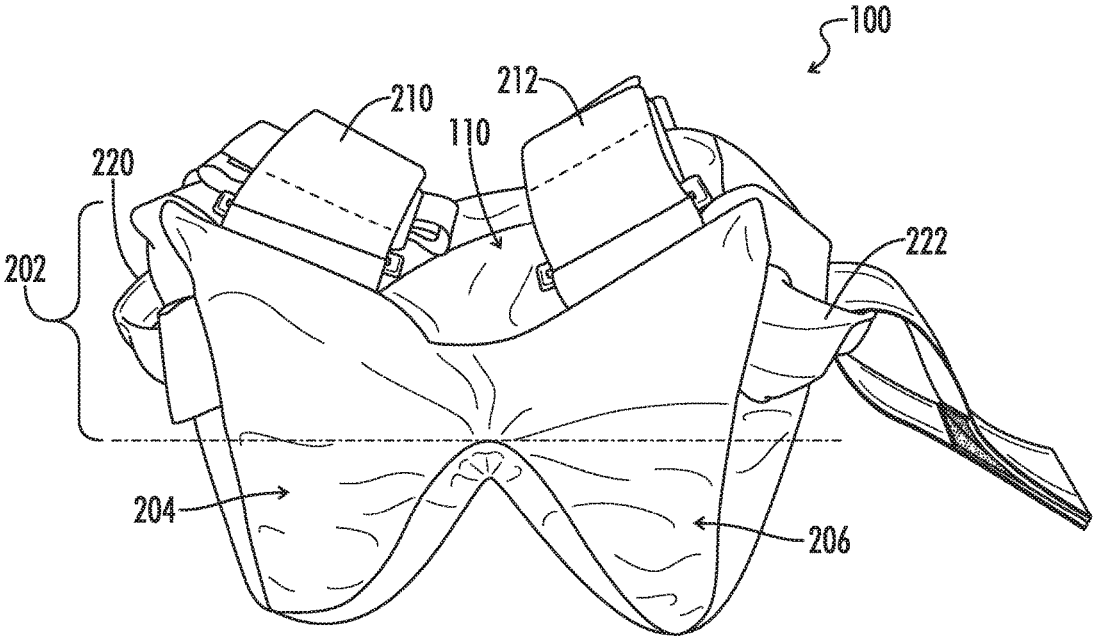
FIG. 2 is an elevated side perspective view of a shooting support according to one embodiment of the invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The upright position is shown in FIGS. 1 and 2 and FIGS. 7 and 8. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Referring to FIGS. 1-6, a shooting support 100 is supporting a firearm 102 on an object 104. In this example, the object 104 is a fence post in the firearm 102 is a rifle. The shooting support 100 is configured to grasp the object 104 by a conforming itself to the shape of the object 104 while a filler (i.e., amorphous material) of the shooting support 100 descends below a top surface of the object 104 to prevent slippage of the shooting support 100 relative to the object 104. The filler distributes itself around the object 104 via gravity such that the top of the shooting support 100 provides a level surface from which to shoot.

In one embodiment, the shooting support 100 includes a main chamber 202, a first lower chamber 204, and a second lower chamber 206. The first lower chamber 204 is connected to the main chamber 202, and the second lower chamber 206 is connected to the main chamber 202. A filler of amorphous material is contained within the main chamber 202. The main chamber 202, first lower chamber 204, and second lower chamber 206 are in fluid communication with one another such that the filler can flow between all of the main chamber 202, first lower chamber 204, and second lower chamber 206. In one embodiment, the filler of amorphous material is plastic beads (e.g., polycarbonate beads or sand). In one embodiment, the shell of the main chamber 202, first lower chamber 204, and second lower chamber 206, is formed of a pliable textile (e.g., canvas, nylon, or duck cloth). In one embodiment, a top 110 of the main chamber 202 is concave when the shooting bag 100 is placed on a flat surface. The first chamber 204, and the second chamber 206 extend downwardly from the main chamber 202 when the shooting support is in an upright position.

In one embodiment, the shooting support 100 further includes a first attachment point 210 and the second attachment point 212. The first attachment point 210 is at the top 110 of the main chamber 202 and is positioned over the first lower chamber 204. The second attachment point 212 is at the top 110 of the main chamber 202 and is positioned over the second lower chamber 206. The first attachment point 210 and the second attachment point 212 are straps including hook and loop fastener systems. The first attachment point 210 and the second attachment point 212 are each attached to the main chamber 202 at opposing sides of the main chamber 202 over the respective first and second lower chambers 204, 206. In one embodiment, the first attachment point 210 and the second attachment point 212 are attached to the top 110 of the main chamber 202 via a D rings such that they are removable. The first attachment point 210 and the second attachment point 212 function to retain the shooting support 100 on the firearm 102 when the firearm 102 and shooting support 100 are removed from the object 104.

In one embodiment, the shooting support 100 further includes a first grab handle 220 and a second grab handle 222. The first grab handle 220 is attached to the main chamber 202 at a first end outboard of the first lower chamber 204. The second grab handle 222 is attached to the main chamber to a 2 and a second end opposite the first end of the main chamber 202 outboard of the second lower chamber 206.

Figure 3:
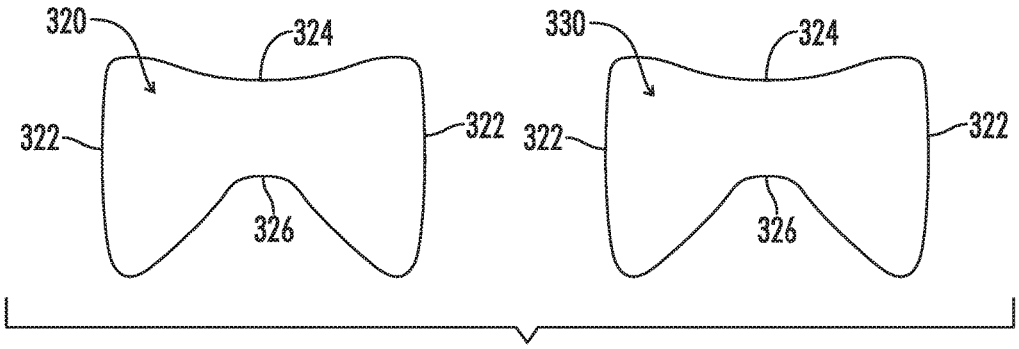
FIG. 3 is an outline of a first panel and second panel of the shooting support of FIG. 2.
Figure 4:
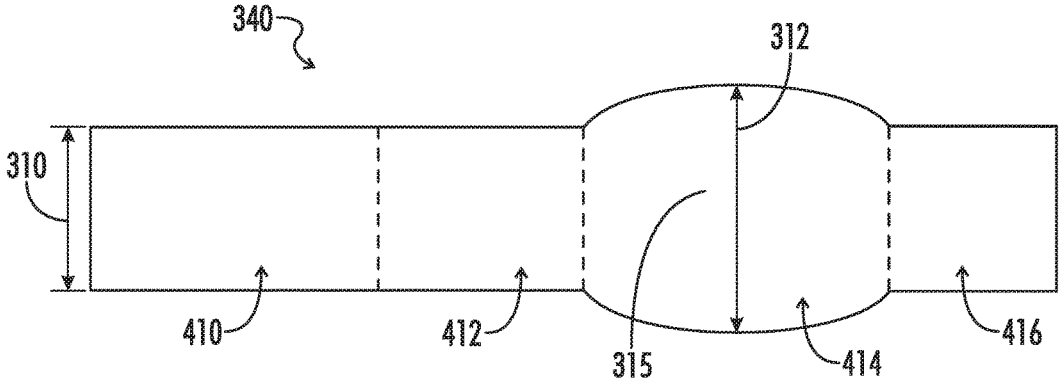
FIG. 4 is an outline of the joining panel of the shooting support of FIG. 2.
Figure 5:
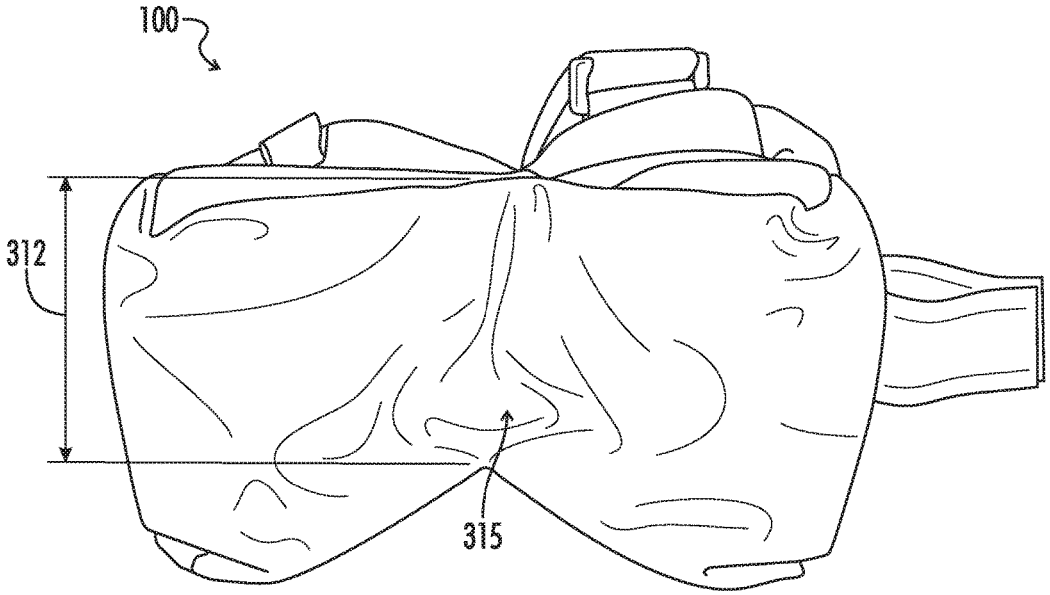
FIG. 5 is a bottom perspective view of the shooting support of FIG. 2.
Figure 6:
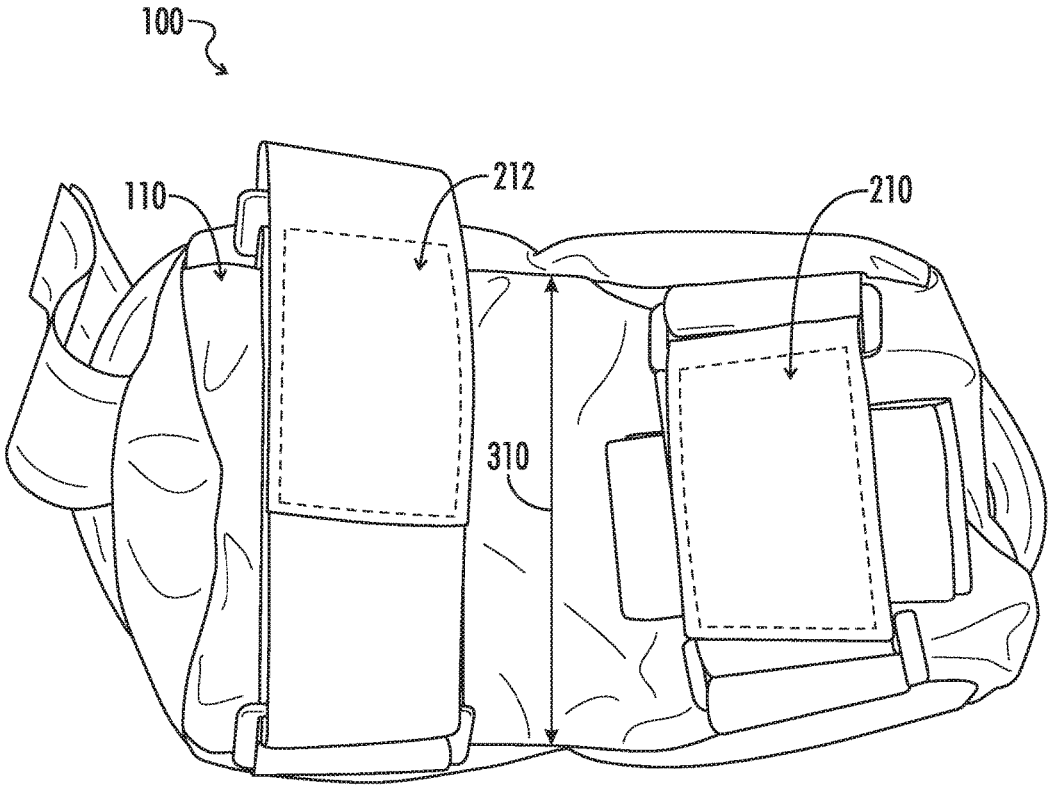
FIG. 6 is a top perspective view of the shooting support of FIG. 2.
Figure 7:
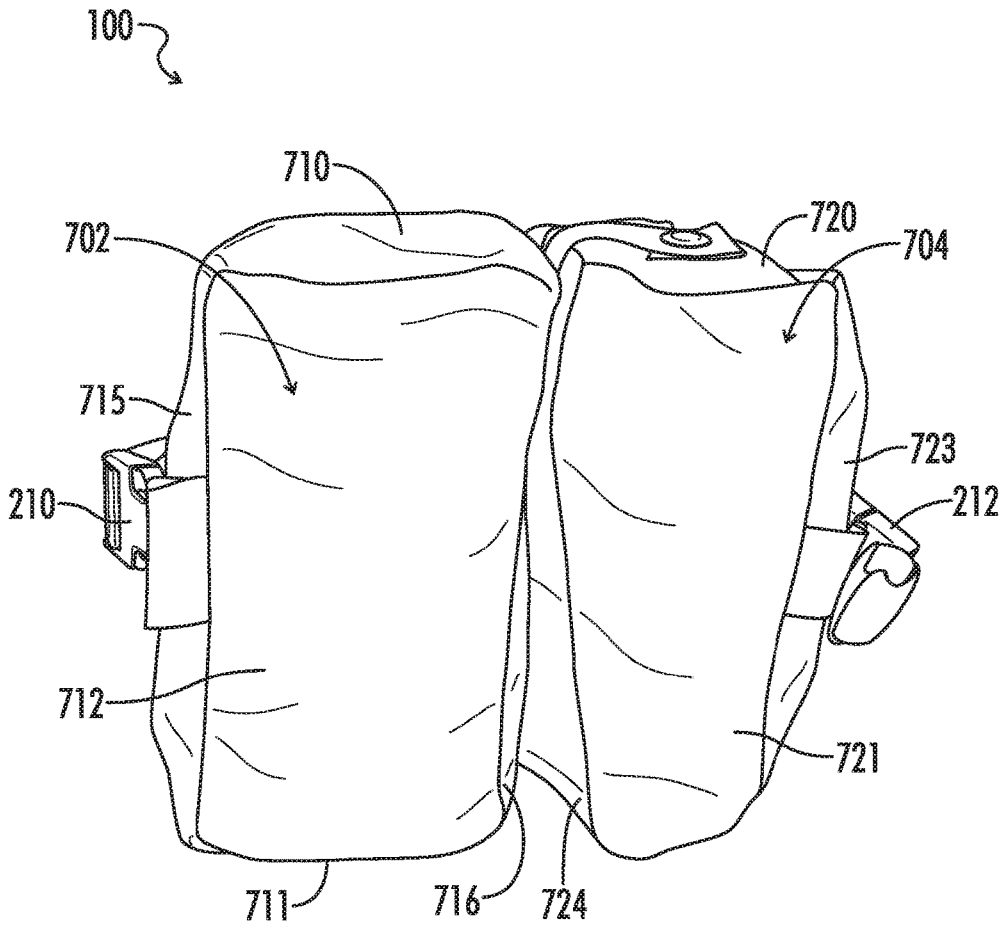
FIG. 7 is a side perspective view of a shooting support according to one embodiment of the invention.
Figure 8:
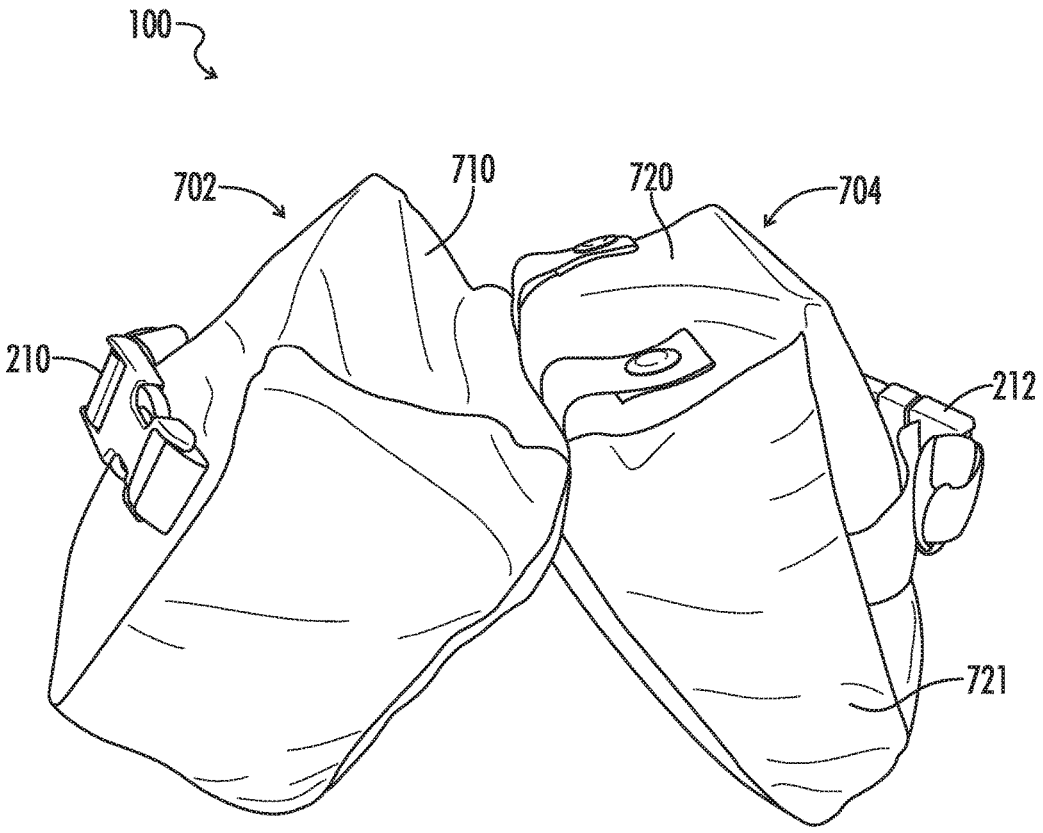
FIG. 8 is a side perspective view of the shooting support of FIG. 7 with the two bags of the shooting support attached to one another and spread apart.
Figure 9:
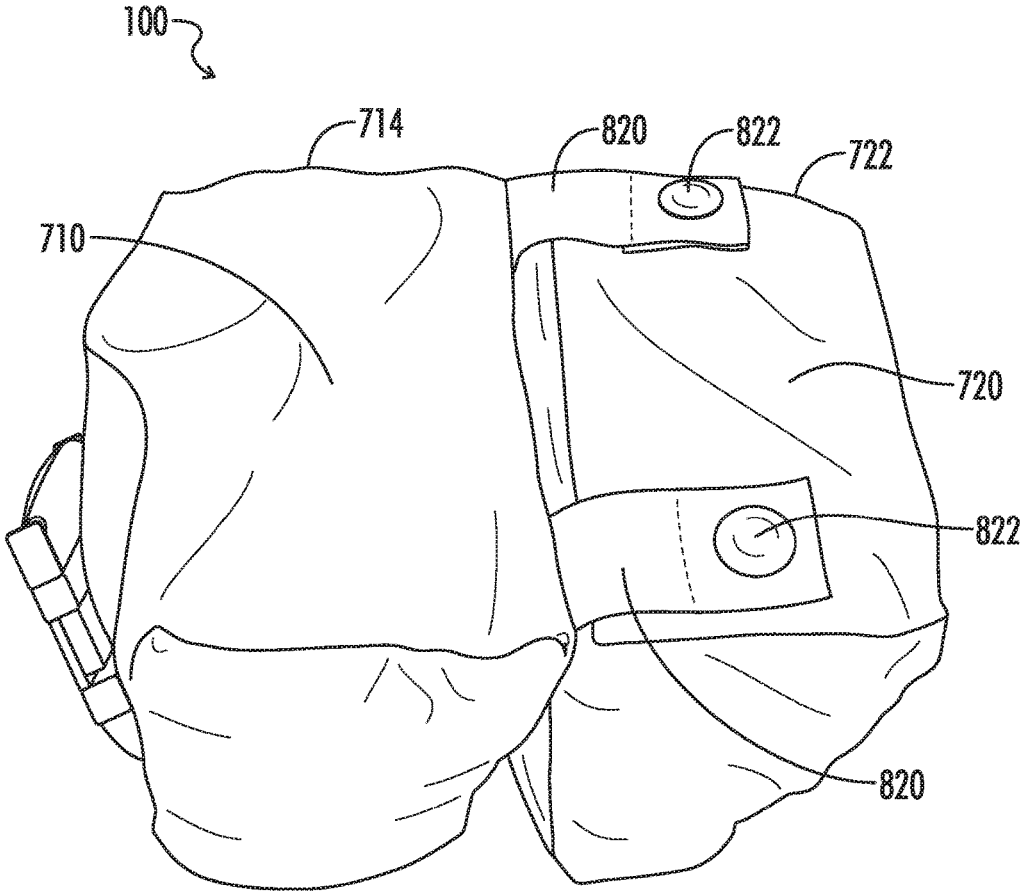
FIG. 9 is a top perspective view of the shooting support of FIG. 7.
Figure 10:
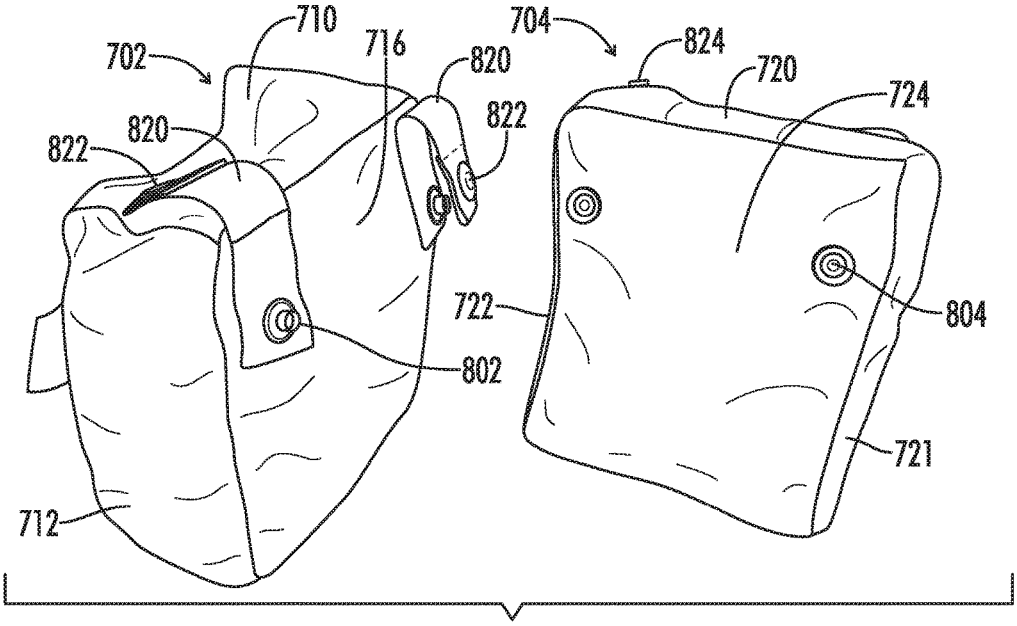
FIG. 10 is a side perspective view of the shooting support of FIG. 7 with the two bags of the shooting support selectively detached from one another.
Figure 11:
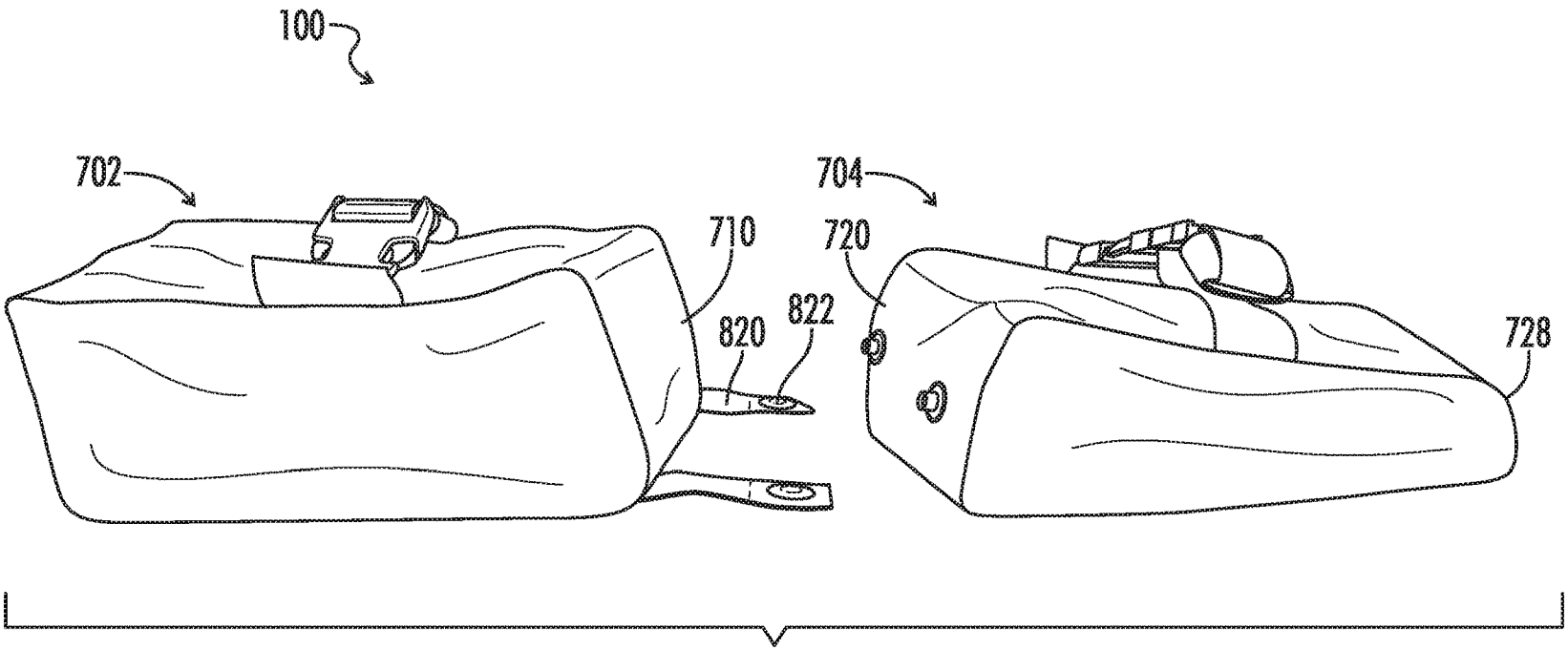
FIG. 11 is a side perspective view of the shooting support of FIG. 7 with the two bags of the shooting support selectively detached from one another and positioned to receive a fore end and a butt stock of a firearm.

Referring particularly to FIGS. 3 and 4, the shooting support 100 has a first panel 320 and a second panel 330. The first panel 320 and the second panel 330 each have a butterfly outline. The butterfly outline includes opposing sides 322, a top 324 extending between the opposing sides 322, and a bottom 326 extending between the opposing sides 322. The top 324 and the bottom 326 are closer to one another between the opposing sides 322 than at the opposing sides 322. Thus, the outline of the first panel 320 and the second panel 330 form butterflies or W shaped outlines.

The shooting support 100 further includes a joining panel 340 joining the first panel 320 to the second panel 330 along the outline of each of the first panel 320 and the second panel 330 such that the butterfly outlines of the first and second panels 320, 330 are aligned. In one embodiment, the joining panel 340 includes a top joining section 410 having a first width 310. The top joining section 410 connects the top 324 of the first panel 322 the top 324 of the second panel 330 and limits the distance between the top 324 of the first panel 320 and the top 324 of the second panel 330 to the first width 310. The joining panel 340 further includes a first side joining section 412 adjacent the top joining section 410. The first side joining section 412 connects a first side of the opposing sides 322 of the first panel 320 to a corresponding first side of the opposing sides 322 of the second panel 330. The first side joining section 412 has the first width 310. The joining panel 340 further includes a bottom joining section 414 adjacent the first side joining section 412. The bottom joining section 414 connects the bottom 326 of the first panel 320 to the bottom 326 of the second panel 330. The bottom joining section 414 has a second width 312 greater than the first width 310 of the top joining section 410. Thus, in one embodiment, the width 312 of a bottom 315 of the main chamber 202 is greater than the width 310 of the top 110 of the main chamber 202 between the first lower chamber 204 and the second lower chamber 206. This enables the shooting support 100 to better mold around the object 104 when the object does not extend laterally beyond the first panel 320 and the second panel 330. The joining panel 340 further includes a second side joining section 416 adjacent the bottom joining section 414. The second side joining section 416 connects a second side of the opposing sides 322 of the first panel 320 to a second side of the opposing sides 322 of the second panel 330. The second side joining section 416 has the first width 310.

Referring to FIGS. 7-11, a shooting support 100 includes a first bag 702 and a second bag 704. The first and second bags 702, 704 are configured to selectively attached to one another. The first bag 702 is formed with 6 sides such that the first bag 702 is a top 710, bottom 711, first side 712 second side 714 opposite the first side 712, outer side 715, and inner side 716 opposite the outer side 715. The second bag 704 is formed with at least 5 sides. The second bag 704 has a top 720, the first side 721, a second side 722, and outer side 723, and an inner side 724 opposite the outer side 723. In one embodiment, the second bag 704 further includes a bottom 728. In one embodiment, the inner side 724 and outer side 723 of the second bag 704 attached to one another at a bottom of the inner side 724 and a bottom of the outer side 723 such that the second bag 704 has is wedge-shaped. In another embodiment, the bottom 728 of the second bag 704 is smaller than the top 720 of the second bag 704 such that the inner side 724 of the second bag 704 and the outer side 723 of the second bag 704 are retained closer to one another at a bottom of the inner side 724 and a bottom of the outer side 723 the net a top of the inner side 724 and a top of the outer side 723. Thus, the second bag 704 is wedge-shaped. When the first bag 72 in the second bag 704 are detached from one another, the wedge-shaped of the second bag 704 lends itself to conforming to the butt stock of the firearm 102 while the first bag 702 is level for supporting the hand guard or fore end of the firearm 102. In one embodiment, the inner side of the first bag 716 in the inner side of the second bag 724 are formed of a nonslip material. Nonslip material may be rubber or silicone coated nylon.

In one embodiment, the first bag 702 and the second bag 704 are configured to selectively attached to one another via an attachment fitting 802 on the inner side 716 of the first bag 702 and a corresponding attachment fitting 804 on the inner side 724 of the second bag 702. The attachment fitting 802 on the inner side 716 of the first bag 702 is closer to the top 710 of the first bag 702 in the bottom 711 of the first bag 702. Similarly, the corresponding attachment fitting 804 on the inner side 724 of the second bag 704 is closer to the top 720 of the second bag 704 than the bottom of the inner side 724 of the second bag 704. The attachment fitting 802 and corresponding attachment fitting 804 are configured to meet up with one another when the first bag 702 and the second bag 704 are attached to one another. In one embodiment, the attachment point it 02 on the inner side 716 of the first bag 702 includes a pair of fittings equidistant from the top 710 of the first bag 702 and spaced apart from one another. Similarly, the corresponding attachment. 804 on the second bag 704 is a pair of corresponding fittings 804 equidistant from the top 720 of the second bag 704 and spaced apart from one another. In one embodiment, the attachment fittings 802 are mail snap fastener portions, and the corresponding attachment fittings 804 are female snap fastener portions.

In one embodiment, the first bag 702 and the second bag 704 are configured to selectively attached to one another via a strap at 20 connected to the inner side 716 of the first bag 702. Strap 820 has an attachment fitting 822 affixed thereto, and the second bag 704 has a corresponding attachment fitting 824 on the top 720 of the second bag 704.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful GRASPING FRONT SUPPORT BAG FOR FIREARM STABILITY it is not intended that such references be construed as limitations upon the scope of this invention except as set forth in the following claims.

What is claimed is:

1. A shooting support comprising:

a main chamber;

a first lower chamber extending downwardly from the main chamber;

a second lower chamber extending downwardly from the main chamber; and a filler contained within the main chamber, the first lower chamber, and the second lower chamber, wherein the main chamber, the first lower chamber, and the second lower chamber are in fluid communication with one another such that the filler can flow between all of the main chamber, the first lower chamber, and the second lower chamber;

wherein a width of a bottom of the main chamber is greater than a width of a top of the main chamber between the first lower chamber and the second lower chamber.

2. The shooting support of claim 1, wherein the butterfly outline comprises:

opposing sides;

a top extending between the opposing sides; and a bottom extending between the opposing sides, wherein the top and the bottom are closer to one another between the opposing sides than at the opposing sides.

3. The shooting support of claim 1, wherein:

the shooting support is formed with six sides such that the shooting support has a top, a bottom, a first side, a second side opposite the first side, a first end, and a second end opposite the first side; and the top and the bottom of the shooting support are concave when the shooting support is placed in an upright position on a flat surface.

4. The shooting support of claim 3, wherein:

the first side is formed by a first panel having a butterfly outline; and the second side is formed by a second panel having the butterfly outline.

5. The shooting support of claim 1, wherein:

the first and second lower chambers define between them a space located below the main chamber in which an object is receivable to prevent slippage of the shooting support relative to the object.

6. The shooting support of claim 1, wherein:

a top of the main chamber is concave when the shooting support is placed in an upright position on a flat surface.

7. The shooting support of claim 1, further comprising:

a first grab handle attached to the main chamber at a first end outboard of the first lower chamber; and a second grab handle attached to the main chamber at a second end opposite the first end of the main chamber, outboard of the second lower chamber.

8. The shooting support of claim 1, further comprising:

an attachment point attached to a top of the main chamber at opposing sides of the main chamber.

9. The shooting support of claim 8, wherein:

the attachment point is attached to the top of the main chamber at opposing sides of the main chamber over the first or second lower chamber.

10. The shooting support of claim 8, wherein:

the attachment point is a strap comprising hook and loop fasteners.

11. The shooting support of claim 8, wherein:

the attachment point is a strap comprising a male snap fastener portion and a corresponding female snap fastener portion.

12. A shooting support comprising:

a first panel having a butterfly outline;

a second panel having a butterfly outline; and a joining panel joining the first panel to the second panel along the outline of each of the first panel and second panel such that the outlines of the first and second panels are aligned;

wherein:

each outline comprises opposing sides, a top extending between the opposing sides, and a bottom extending between the opposing sides, the top and the bottom being closer to one another between the opposing sides than at the opposing sides;

the bottom of the outline of the first panel is concave;

the bottom of the outline of the second panel is concave;

the top of the outline of the first panel is concave;

the top of the outline of the second panel is concave; and the first panel and the second panel each extend generally vertically when the shooting support is in the upright position.

13. The shooting support of claim 12, wherein the joining panel comprises:

a top joining section having a first width, said top joining section connecting a top of the first panel to a top of the second panel and limiting the distance between the top of the first panel and the top of the second panel to the first width;

a first side joining section adjacent the top joining section, said first side joining section connecting a first side of the first panel to a first side of the second panel, wherein the first side joining section has the first width;

a bottom joining section adjacent the first side joining section, said bottom joining section connecting a bottom of the first panel to a bottom of the second panel, wherein the bottom joining section has a second width greater than the first width of the top joining section; and a second side joining section adjacent the bottom joining section, said second side joining section connecting a second side of the first panel to a second side of the second panel, wherein the first side of the first panel is opposite the second side of the first panel and the first side of the second panel is opposite the second side of the second panel, and the second side joining section has the first width.

14. The shooting support of claim 12, wherein the first panel and the second panel are formed of a pliable textile and the shooting support is partially filled with an amorphous material, said amorphous material being plastic beads.

* * * * *